United States Patent [19]

Brown et al.

[11] 3,977,328

[45] Aug. 31, 1976

[54] DETONATORS

[75] Inventors: Kenneth Raymond Brown, Broadstone; Rodney Lane, Wareham; Douglas Reginald Luff, Poole, all of England

[73] Assignee: The Secretary of State for Defence in Her Britannic Majesty's Government of the United Kingdom of Great Britain and Northern Ireland, London, England

[22] Filed: Oct. 1, 1973

[21] Appl. No.: 399,934

[30] Foreign Application Priority Data

Oct. 2, 1972 United Kingdom ..... 45429/72

[52] U.S. Cl. ..... 102/70.2 GA; 252/62.9; 310/9.7

[51] Int. Cl.[2] ..... F42C 11/02; C04B 35/00

[58] Field of Search ..... 102/70.2 GA; 252/62.9; 310/8, 9.1, 9.2, 9.7

[56] References Cited

UNITED STATES PATENTS

| | | | |
|---|---|---|---|
| 2,449,484 | 9/1948 | Jaffe | 252/62.9 |
| 2,853,012 | 9/1958 | Rotkin et al. | 102/70.2 GA |
| 2,911,370 | 11/1959 | Kulcsar | 252/62.9 |
| 3,006,857 | 10/1961 | Kulcsar | 252/62.9 |
| 3,068,177 | 12/1962 | Sugden | 252/62.9 |
| 3,106,161 | 10/1963 | Wallbaum et al. | 102/70.2 GA |
| 3,144,411 | 8/1964 | Kulcsar et al. | 252/62.9 |
| 3,179,594 | 4/1965 | Kulcsar et al. | 252/62.9 |
| 3,216,943 | 11/1965 | Jaffe et al. | 252/62.9 |

OTHER PUBLICATIONS

Takahashi et al., "Electromechanical Properties of $Pb(Zr.Ti)O_3$ Ceramics Containing Impurities Injected by Means of Thermal Diffusion", *Japan J. Appl. Phys.*, 9, No. 8 (1970) 1006.

*Primary Examiner*—Charles T. Jordan
*Attorney, Agent, or Firm*—Stevens, Davis, Miller & Mosher

[57] ABSTRACT

A detonator operated by signals derived from a piezoelectric transducer element when subjected to mechanical pressure wherein the piezoelectric transducer element has a resistivity of less than about 5 × 10 inches Ωcm.

3 Claims, 2 Drawing Figures

DETONATORS

This invention relates to detonators, more particularly to detonators operable by electric signals derived from a piezoelectric transducer element when subjected to mechanical pressure.

Conventionally such detonators generally comprise an inert cup of such as alumina or plastic in which is placed a conducting disc of a metal such as brass. Next to the conducting disc is provided an insulating spark gap washer having a central bore forming a spark gap between one surface of a piezoelectric element on one side of the insulating washer and the conducting disc on the other. Mounted against the opposite wall of the piezoelectric element in an anvil separated from a brass plate by an air gap, known in the art as the anvil gap. When the detonator is operated, for example, on impact with the ground, the anvil is placed against the brass plate with sufficient force to generate a voltage across the piezoelectric element which jumps the spark gap to operate a trigger. Commonly an arming switch is provided such that the generated voltage can only reach the trigger when the detonator is to be used. A high resistance shunt is provided to dissipate any generated voltage on the piezoelectric transducer element when the device is not armed.

Frequently a timing mechanism is provided to close the arming switch only after a preset time after the commencement of, for example, an air-drop of the device. However it has been found that a number of premature detonations have occurred with this type of detonator in air drops. At best this is wasteful in material at worst it is dangerous, in, for example, where the device has to be armed on leaving an aircraft, say in a low level operation.

It is an object of the present invention to provide a detonator wherein the risk of premature detonation is eliminated or at least substantially reduced.

It is a further object to provide a detonator having a piezoelectric transducer element permitting the internal dissipation of charge built up on piezoelectric transducer element as a result of chattering of the anvil against the base plate after arming. Hitherto this charge build-up has been dissipated in the trigger setting-off the premature detonation.

According to the present invention a detonator as set forth and having an oxide ferroelectric transducer is characterized in that the oxide ferroelectric transducr is uranium doped. It has been discovered that, surprisingly, oxide ferroelectric transducers doped with uranium have resistivities of two or three orders less than that of undoped material.

In a detonator as described in the preceding two paragraphs it is preferred that the oxide ferroelectric is a polycrystalline ceramic consisting essentially of lead, zirconium, titanium and oxygen in substantially stoichiometric proportions corresponding to lead zirconate and lead titanate in a mol ratio in the range 60:40 to 35:55. Such a ceramic has been found to have good reproducible piezoelectric properties and is easily and cheaply manufactured.

It has been found that the best properties in a piezoelectric ceramic as described in the preceding paragraph are obtained when the mol fraction of lead titanate is in the range 47.0 to 48.2%.

It is preferred that the upper limit of uranium doping in a lead zirconate titanate ceramic element used in connection with present invention is set at a quantity of uranium equivalent to up to 1.5% by weight of the oxide $U_3O_8$. Beyond this limit the performance of detonators incorporating the piezoelectric element deteriorates for slow impacts as the charge developed leaks away before reaching its maximum value.

In order that the invention might be more fully understood and further features appreciated, the following description will refer, by way of example only, to the accompanying drawings.

Figure 1:
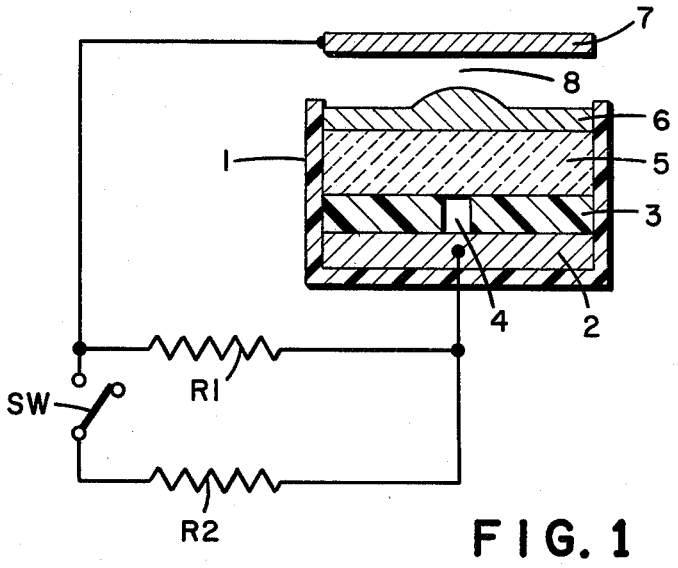
FIG. 1 is a schematic diagram of a detonator.

In FIG. 1, a detonator comprises a cylindrical cup 1 wherein is placed a disc 2 and a spark gap washer 3 having a central orifice 4. A piezoelectric disc 5 is placed in contact with washer 3, such that orifice 4 provides a spark gap between one wall of the piezoelectric transducer 5 and disc 2. Against the other wall of the piezoelectric crystal 5 is an anvil 6 separated from a base plate 7 by anvil gap 8. Plate 2 is electrically connected to base plate 7 through a trigger represented as a resistor R2 in series with arming switch SW (shown in the inoperative position). The detonator is electrically shunted by a high resistance R1.

When the detonator housing (not shown) first opens the anvil 6 is pushed against base plate 7 with sufficient force to generate a voltage across the piezoelectric crystal 5. However as, for this instant, anvil gap 8 is closed, the voltage may be discharged through the high resistor R1, provided the generated voltage is high enough to jump the spark gap. On completion of the opening pressure on the base plate 7 is released the anvil gap 8 opens again and a reverse voltage appears across the piezoelectric disc, which may be dissipated by chattering of the anvil gap. A timing mechanism closes the arming switch, and if further voltages build up and discharge across the spark gap they will be dissipated in the trigger resistance R2 triggering detonation. Utilization of a low resistance piezoelectric transducer as required by the present invention allows this further voltage build up to be dissipated internally in the piezoelectric.

On impact with a target, the anvil 6 strikes the base plate 7 hard, producing a voltage pulse on the piezoelectric transducer 5, which not having time to dissipate itself within the disc, jumps the spark gap setting off detonation.

The properties of ceramics for use in connection with the present invention are illustrated in the following tabulated examples.

Table 1 of examples 1 – 20 shows the dielectric constant and resistivities of a number of piezoelectric ceramic compositions, examples 1 – 19 are of ceramics suitable for use in detonators according to the invention, and example 20 is standard commercial lead zirconate titanate ceramic known under the trade name "VERNITRON 4A" whose properties have been included for comparison.

TABLE 1

| Example | COMPOSITION MOL lead zirconate/ lead titanate | % SrO | Weight% $U_3O_8$ | (1)$\epsilon$ | (2)$k_p$ | (3)$\rho$ $\Omega$cm $\times 10^8$ |
|---|---|---|---|---|---|---|
| 1 | 53.0/47.0 | 0 | 0.8 | 470 | 0.46 | 130 |
| 2 | 52.6/47.4 | 0 | 0.8 | 500 | 0.47 | 160 |
| 3 | 52.4/47.6 | 0 | 0.8 | 530 | 0.47 | 140 |
| 4 | 52.0/48.0 | 0 | 0.8 | 680 | 0.48 | 140 |
| 5 | 53.0/47.0 | 0 | 1.2 | 460 | 0.47 | 29 |
| 6 | 52.6/47.4 | 0 | 1.2 | 490 | 0.46 | 24 |
| 7 | 52.4/47.6 | 0 | 1.2 | 520 | 0.47 | 26 |
| 8 | 52.0/48.0 | 0 | 1.2 | 590 | 0.49 | 24 |
| 9 | 53.0/47.0 | 3 | 0.8 | 1520 | 0.53 | 72 |
| 10 | 52.6/47.4 | 3 | 0.8 | 1680 | 0.52 | 72 |
| 11 | 52.2/47.8 | 3 | 0.8 | 1610 | 0.50 | 46 |
| 12 | 51.8/48.2 | 3 | 0.8 | 1550 | 0.48 | 71 |
| 13 | 53.0/47.0 | 3 | 1.2 | 1230 | 0.51 | 29 |
| 14 | 52.6/47.4 | 3 | 1.2 | 1320 | 0.52 | 17 |
| 15 | 52.2/47.8 | 3 | 1.2 | 1520 | 0.51 | 23 |
| 16 | 51.8/48.2 | 3 | 1.2 | 1530 | 0.51 | 23 |
| 17 | 52.6/47.4 | 0 | 0.4 | 610 | 0.48 | 72 |
| 18 | " | 0 | 0.6 | 550 | 0.47 | 71 |
| 2 | " | 0 | 0.8 | 500 | 0.47 | 160 |
| 19 | " | 0 | 1.0 | 480 | 0.47 | 56 |
| 6 | " | 0 | 1.2 | 490 | 0.46 | 24 |
| 20 | 53.0/47.0 | 0 | 0 | 1200 | 0.50 | >20000 |

Resistivities were measured at a field of 100 v/mm; these measurements should be regarded as minimum values since they were taken immediately after field application.

F*c* is a pyroelectric figure of merit, charge sensitivity C.mm/J).

F*v* is a pyroelectric figure of merit, voltage sensitivity (C.mm/J).

$\epsilon$ is the dielectric constant

K*p* is the planar electro-mechanical coupling coefficient for a disc.

$\rho$ is the resistivity.

Most piezoelectric ceramics have high resistivity and this is illustrated by example 20 whose resistivity is greater than $2\times10^{12}$ $\Omega$cm. Nineteen other lead zirconate titanate specimens were prepared having uranium as a dopant; partial substitution of lead by strontium was made in eight cases (examples 9–16). The ratios of lead zirconate to lead titanate (LZ/LT) were in the range 51.8/48.2 to 53.0/47.0. The ceramic test samples were prepared using conventional technology; the processing conditions in this case being : milling for 2 hours, reaction 850°C, milling 8 hours, sinter 1200°C × 6 hours.

The piezoelectric and dielectric properties of the materials of examples 1–19 are fairly high but the resistivity values are a factor of 100–1000 lower than example 20. The overall effect of increasing the level uranium of the doping is to decrease all electrical properties, if only slightly in some cases. It has been found that partial substitution of lead by alkaline earth metals increases both the planar coupling coefficient and the dielectric constant. Examples 9 to 16 demonstrate the results obtained from strontium substituted materials. It will be seen that substitution by about 3 mol percent strontium oxide in the basic ceramic is effective in restoring the dielectric constant and planar coefficient to their original values. Strontium is the preferred substituent as its atomic radius most closely matches that of lead.

From these compositions a very good piezoelectric detonator material can be chosen which not only has high electrical energy/mechanical stress sensitivity but which is also very safe because the low resistivity allows unwanted charge to bleed away by internal leakage with a time constant which is less than the arming time.

The parameters reported in Table 1 are not sufficient however to determine detonation performance and consequently further experiments to investigate the spark produced by slow and quick stress applications were carried out.

Charge decay characteristics were obtained by applying a known force to a ceramic disc by a lever press and measuring the remnant charge after various times. An initial measurement was obtained with an electrometer connected to the ceramic while the stress was being applied. In this way no charge was lost by conduction through the ceramic and the signal was a maximum. In the second and subsequent measurements the stress was applied with the ceramic on open circuit, after a measured time interval the electrometer was connected and the charge release measured.

Initially experiments were made to determine the charge decay times for a number of ceramic materials (examples 21–31) and the results are shown in Table 2.

TABLE 2

| Example | COMPOSITION MOL % lead zirconate/ lead titanate | SrO | WT% $U_3O_8$ | TIME SECS | CHARGE COULOMBS $\times 10^{-8}$ |
|---|---|---|---|---|---|
| 21 | 66/34 | 0 | 0.3 | 0 | 4.4 |
| | | | | 15 | 2.5 → 3.2 |
| 22 | " | " | 0.6 | 0 | 5.5 |
| | | | | 15 | 3.0 → 4.0 |
| 23 | " | " | 1.0 | 0 | 5.5 |
| | | | | 15 | 0.2 → 0.5 |
| 24 | " | " | 1.5 | 0 | 4.5 |
| | | | | 15 | 0.2 → 0.5 |
| 25 | 62.38 | " | 0.6 | 0 | 7.0 → 8.0 |
| | | | | 15 | 2.0 → 2.5 |
| 26 | " | " | 1.0 | 0 | 6.5 |
| | | | | 15 | 0.2 → 1.0 |
| 27 | 54/46 | " | 0.6 | 0 | 11.0 → 14.0 |
| | | | | 15 | 2.0 → 5.0 |
| 28 | " | " | 1.0 | 0 | 11.0 |
| | | | | 15 | 1.0 |
| 29 | " | " | 1.5 | 0 | 12.5 |
| | | | | 15 | 0.5 → 1.0 |
| 30 | 58/42 | " | 0.6 | 0 | 10.0 → 11.0 |
| | | | | 15 | 3.0 → 6.0 |
| 31 | " | " | 1.0 | 0 | 8.0 |
| | | | | 15 | 0.2 → 2.0 |

Force applied 400 Newtons

TABLE 3

| EXAMPLE | FORCE N × $10^{+4}$ | TIME SECS | REMENANT VOLTAGE VOLTS | THICK mm | DIA mm |
|---|---|---|---|---|---|
| 20 | 0.78 | 0 | 1,700 | 5.08 | 25.47 |
| | " | 40 | 1,260 | | |
| | " | 140 | 700 | | |
| 21 | 0.54 | 0 | 1,700 | 3.95 | 19.47 |
| | " | 15 | 500 | | |
| 22 | 0.78 | 0 | 1,700 | 3.50 | 19.35 |
| | " | 15 | 550 | | |
| 23 | No breakdown on application | | | 3.69 | 19.34 |
| | 1.5 | 0 | 1,700 | | |
| 24 | No breakdown on application or release to 2.104 N | | | 3.82 | 19.31 |
| 25 | 0.62 | 0 | 1,700 | 3.68 | 19.48 |
| | " | 20 | 350 | | |
| | " | 40 | 250 | | |
| 26 | No breakdown on application | | | 3.73 | 19.35 |
| | 1.16 | 0 | 1,700 | | |
| 27 | 0.62 | 0 | 1,700 | 3.50 | 19.36 |
| | " | 25 | 350 | | |
| 28 | No breakdown on application | | | 3.36 | 19.39 |
| | 1.16 | 0 | 1,700 | | |
| 29 | 0.62 | 0 | 1,700 | 3.70 | 19.43 |
| | " | 20 | 250 | | |
| 30 | No breakdown on application | | | 3.32 | 19.35 |
| | 1.16 | 0 | 1,700 | | |
| 31 | No breakdown on application or release to 2.104N | | | 3.44 | 19.54 |

NB Pressure applied in a hydraulic press; time for application of stress 2 secs time for release of stress 0.5 secs.
where no breakdown occurred on stress application figures are for stress release The results shown in Table 3 were obtained from an experiment similar to the remnant charge method used in Table 2 but in this case the voltage was measured at various times after application or release of a known stress.

A calibration curve for the spark gap was plotted by connecting a high voltage generator across the spark gap and measuring on an electrostatic voltmeter, the voltage required to cause breakdown. The voltage decay was then obtained by applying a known load to the ceramic with a wide gap separation and decreasing the gap separation until breakdown occurred. The gap separation and time after stress applications was then measured. The load used in each case was that required to give breakdown of a 0.25 mm gap immediately after stress application (i.e. to produce a voltage of 1,700 V)

The results shown in Table 3 indicate that the standard of example 20 has a low decay rate while the uranium doped materials have a relatively fast decay rate. In agreement with the charge decay measurements, an increase in the uranium dopant produced a higher decay rate. In certain compositions no discharge could be achieved upon application of a force of 20,000 N, presumably because the time to achieve maximum stress was too long, although discharge was obtained upon release of the stress. In other compositions no discharge could be realized upon stress application or release. The estimated time required to achieve maximum stress was 1–2 seconds, although stress release could be made more rapidly within ≈0.5 seconds. It appears, therefore, that significant voltage decay occurs for certain uranium doped ceramics within 0.5 secs.

Measurements on the high $k$ materials of examples 1–19 were obtained by the spark gap method described previously and the results are reported in Table 4. In all cases no detectable voltage could be found after a period of 10–15 seconds following stress application. In certain cases, for high uranium doped materials, no discharge could be achieved immediately after stressing; furthermore in certain other cases no discharge was realized on stress release. The voltage decay is particularly rapid for examples 5–8 in which the very high decay rates could suppress the peak voltages achieved in this tuype of experiment.

Measurements of the electromechanical coupling factor before and after stressing show that no significant depolarization has occurred during testing so that the results are truly representative of the low stress properties.

TABLE 4

| Example | SPECIMEN DIA mm | THICK mm | FORCE N × $10^{+4}$ | TIME SECS | REMANENT VOLTAGE VOLTS | $k_d$ BEFORE STRESS | AFTER STRESS |
|---|---|---|---|---|---|---|---|
| 1 | 25.40 | 4.53 | 1.17 App | 0 | 1700 | .47 | .47 |
| | | | 0.93 Rel | 0 | 1700 | | |
| | | | 1.17 App | 15 | ≈0 | | |
| 2 | 25.46 | 5.03 | 0.93 App | 0 | 1700 | .47 | .47 |
| | | | 0.93 Rel | 0 | 1700 | | |
| | | | 0.93 App | 15 | ≈0 | | |
| 3 | 25.44 | 5.03 | 0.78 App | 0 | 1700 | .47 | .47 |
| | | | 0.78 Rel | 0 | 1700 | | |
| | | | 0.78 App | 10 | ≈0 | | |
| 4 | 25.49 | 5.10 | 0.78 App | 0 | 1700 | .48 | .48 |
| | | | 0.78 Rel | 0 | 1700 | | |
| | | | 0.78 App | 10 | ≈0 | | |
| 5 | 25.42 | 4.85 | 1.56 App | 0 | No B | .45 | .45 |
| | | | 1.56 Rel | 0 | " | | |
| | | | 1.17 App | 0 | "* | | |
| | | | 1.17 Rel | 0 | 900* | | |
| 6 | 25.42 | 5.13 | 1.56 App | 0 | No B | .47 | .47 |
| | | | 1.36 Rel | 0 | 1700 | | |
| 7 | 25.41 | 5.16 | 1.56 App | 0 | No B | .47 | .47 |
| | | | 1.56 Rel | 0 | 1700 | | |
| 8 | 25.38 | 5.06 | 1.56 App | 0 | No B | .48 | .48 |
| | | | 1.36 Rel | 0 | 1700 | | |
| 9 | 25.56 | 5.04 | 0.93 App | 0 | 1700 | .53 | .53 |
| | | | 0.93 Rel | 0 | 1700 | | |
| | | | 0.93 App | 15 | ≈0 | | |
| 10 | 25.54 | 5.14 | 0.93 App | 0 | 1700 | .52 | — |
| | | | 0.93 Rel | 0 | 1700 | | |
| | | | 0.93 App | 10 | ≈0 | | |
| 11 | 25.57 | 4.86 | 1.17 App | 0 | 1700 | .50 | .49 |
| | | | 1.17 Rel | 0 | 1700 | | |
| | | | 1.17 App | 10 | ≈0 | | |
| 12 | 25.52 | 5.02 | 1.17 App | 0 | No B | .48 | .47 |
| | | | 1.17 Rel | 0 | 1700 | | |

TABLE 4-continued

| Example | SPECIMEN DIA mm | THICK mm | FORCE N × 10⁺⁴ | TIME SECS | REMANENT VOLTAGE VOLTS | $k_d$ BEFORE STRESS | $k_d$ AFTER STRESS |
|---|---|---|---|---|---|---|---|
| | | | 1.17 App | 10 | ≈0 | | |
| 13 | 25.37 | 4.75 | 1.56 App | 0 | No B | .51 | .49 |
| | | | 1.56 Rel | 0 | 1700 | | |
| | | | 1.56 App | 10 | ≈0 | | |
| 14 | 25.35 | 4.79 | 1.95 App | 0 | No B | .53 | .49 |
| | | | 1.95 Rel | 0 | " | | |
| 15 | 25.47 | 4.92 | 1.95 App | 0 | " | .50 | .46 |
| | | | 1.95 Rel | 0 | 1700 | | |
| | | | 1.95 App | 10 | ≈0 | | |
| 16 | 25.38 | 4.85 | 1.71 App | 0 | No B | .51 | .48 |
| | | | 1.71 Rel | 0 | 1700 | | |
| 17 | 25.52 | 5.11 | 0.62 App | 0 | 1700 | .48 | .49 |
| | | | 0.62 Rel | 0 | 1700 | | |
| | | | 0.62 App | 15 | 1000 | | |
| | | | 0.62 App | 35 | 500 | | |
| 18 | 25.41 | 5.04 | 0.46 App | 0 | 1700 | .48 | .48 |
| | | | 0.46 Rel | 0 | 1700 | | |
| | | | 0.46 App | 15 | ≈0 | | |
| 19 | 25.44 | 5.04 | 0.93 App | 0 | 1700 | .47 | .46 |
| | | | 0.93 Rel | 0 | 1700 | | |
| | | | 0.93 App | 15 | ≈0 | | |
| 20 | 26.47 | 5.08 | 0.78 App | 0 | 1700 | — | — |
| | | | 0.78 App | 40 | 1260 | | |
| | | | 0.78 App | 140 | 700 | | |

*Gap separation 0.13 mm
(1) Pressure applied in a hydraulic press; time of application 2 secs, time for release of stress 0.5 sec.
(2) No B - No breakdown occurs
(3) App - stress applied
Rel - stress released.

The results in Table 4 show that a rapid decay of the piezoelectric signal has been achieved by introducing dc conductivity into the ceramic. This should reduce the pedestal voltage, produced when the housing opens, and consequently prevent premature detonation. It must be established however, that the signal produced on impact is not significantly reduced and this depends on the time for the impact stress to achieve its maximum value. To simulate the impact behavior a shock loading experiment has been initiated.

Shock loading experiments were performed by noting the height from which a known weight had to be dropped to cause breakdown of the spark gap. The results of these experiments are shown in Table 5. No uranium doped material required a larger impulse than the undoped material, example 20, to cause breakdown of the spark gap despite their increased conductivity. Indeed very many of the uranium compositions sparked with a much smaller impulse, presumably due to their much lower permittivities and higher *g* coefficients. A comparison of the impulse required to produce breakdown with the dielectric constant shows a very close agreement. It also appears that there is an advantage in using low permittivity materials since lower stress levels would be required to cause detonation although it must be remembered that as the permittivity is reduced the spark energy is also reduced.

TABLE 5

| EXAMPLE | DIA mm | THICK mm | WEIGHT g | HEIGHT mm | BREAKDOWN GAP mm | BREAKDOWN VOLTAGE Volts | $k_d$ BEFORE STRESS | $k_d$ AFTER STRESS |
|---|---|---|---|---|---|---|---|---|
| 20 | 26.45 | 5.07 | 215 | 250 | 0.13 | 850 | — | — |
| 20 | 25.20 | 5.41 | " | 190 | " | " | — | — |
| 1 | 25.55 | 4.55 | " | 140 | " | | .46 | .46 |
| 2 | 25.49 | 5.04 | " | 150 | " | " | .47 | .47 |
| 3 | 25.45 | 4.54 | " | 220 | " | " | .47 | .47 |
| 4 | 25.37 | 4.85 | " | 210 | " | " | .49 | .49 |
| 5 | 25.40 | 5.19 | " | 180 | " | " | .46 | .46 |
| 6 | 25.47 | 5.08 | " | 220 | " | " | .46 | .46 |
| 7 | 25.47 | 5.00 | " | 190 | " | " | .47 | .47 |
| 8 | 25.32 | 5.09 | " | 170 | " | " | .50 | .49 |
| 9 | 25.50 | 5.06 | " | 180 | " | " | .53 | .53 |
| 10 | 25.47 | 5.00 | " | 280 | " | " | .53 | .53 |
| 11 | 25.55 | 4.87 | " | 150 | " | " | .50 | .50 |
| 12 | 25.49 | 5.02 | " | 150 | " | " | .48 | .48 |
| 13 | 25.40 | 4.75 | " | 120 | " | " | .52 | .53 |
| 14 | 25.43 | 4.71 | " | 120 | " | " | .52 | .53 |
| 15 | 25.47 | 4.92 | " | 130 | " | " | .52 | .52 |
| 16 | 25.41 | 4.98 | " | 140 | " | " | .50 | .50 |
| 17 | 25.54 | 5.11 | " | 90 | " | " | .48 | .49 |
| 18 | 25.43 | 5.04 | " | 80 | " | " | .46 | .47 |
| 19 | 25.39 | 5.06 | " | 90 | " | " | .46 | .47 |
| 10 | 25.52 | 5.03 | " | 230 | " | " | .52 | .52 |

Other tests carried out show that other dopants such as nickel, zinc, magnesium niobium, tantalum and maganese either increase the resistivity of LZT or have little effect. Dopants of chromium provide a material of variable resistivity, and whilst cobalt slightly reduced the resistivity it also reduced the planar coupling coefficient k. From known properties it is desirable to choose lead zirconate titanate materials having a lead zirconate and lead titanate in substantially stochiometric properties corresponding to a ratio between 60:40 and 35:45. Examples 1 to 19 clearly demonstrate that the best properties are obtained when lead titanate is present in the range 47.0 to 48.2 mol percent. Furthermore the best results demonstrate quite clearly the enhancing influence of uranium doping on the performance of piezoelectric elements for detonators.

Figure 2:
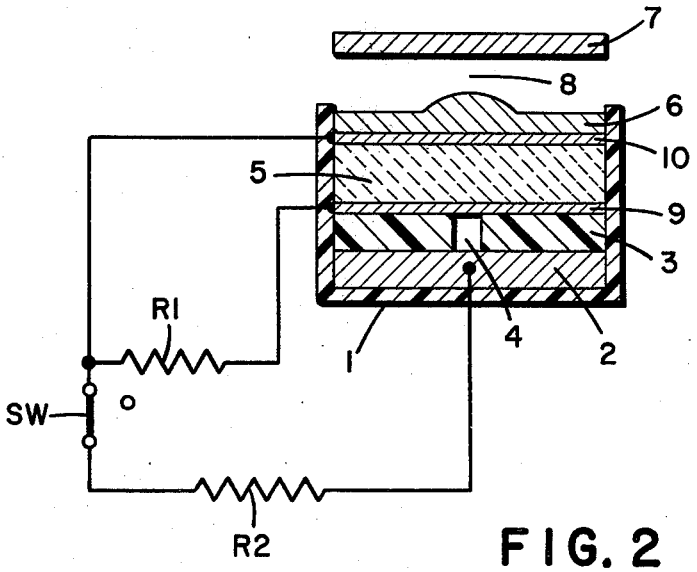
FIG. 2 is a schematic diagram of a modified detonator.

FIG. 2 illustrates an alternative electrical arrangement to that shown in FIG. 1. In this case two brass discs 9 and 19 are introduced on either side of the piezoelectric disc 5. A pair of leads, one lead connected to each brass disc emerge from the side wall of the cylindrical cup 1, and are connected such that high resistor R1 provides a shunt around the piezoelectric disc and the arming switch SW and trigger resistor R2 are in series with brass disc 2 and brass disc 10. Any spurious piezoelectric signals not dissipated internally of the piezoelectric disc can now be bled away through the high resistance R1. On impact, however, the impulsive voltage will jump the spark gap and discharge through low resistor R2.

We claim:

1. A detonator comprising:

an inert cup containing a conducting disc, a piezoelectric disc, an insulating spark gap washer having a central bore forming a spark gap between one surface of the piezoelectric disc on one side of said washer and the conducting disc on the other side of said washer, and an anvil disc mounted with one wall thereof adjacent the surface of the piezoelectric disc opposite said surface of the piezoelectric disc adjacent said washer, a hammer plate, an anvil gap between said hammer plate and said anvil, a trigger, associated electric circuitry whereby when a spark jumps said spark gap an electric pulse may appear in said trigger, an arming switch to open said trigger, wherein said piezoelectric transducer comprises a uranium doped polycrystalline ceramic consisting essentially of lead, zirconium, titanium and oxygen in substantially stoichiometric proportions corresponding to lead zirconate and lead titanate in a mol ratio betwen 53.0: 47.0 and 51.8: 48.2, and the uranium being present in equivalence to 0.4% and 1.5% by weight of the oxide $U_3O_8$.

2. A detonator according to claim 1 wherein strontium is partially substituted for lead in a quantity of strontium equivalent to up to 3 mol percent of the oxide SrO.

3. In a detonator having an inert cup, having the closed bottom and an opposite open end, an electrically conducting disc disposed in the cup against the said bottom, an electrically insulating washer disposed over said disc, said washer having a hole therethrough, a piezoelectric disc disposed on said washer, with the said hole providing a spark gap between the piezoelectric disc and the electrically conductive disc, an anvil closing said open end of the cup, a base plate disposed in spaced relationship opposite said anvil outside said cup, an electrical circuit between said base plate and said electrically conductive disc, said electric circuit having a arming switch therein and a high-resistance shunting means bypassing said arming switch.

* * * * *

UNITED STATES PATENT AND TRADEMARK OFFICE

CERTIFICATE OF CORRECTION

PATENT NO. : 3,977,328

DATED : August 31, 1976

INVENTOR(S) : Kenneth Raymond Brown, Rodney Lane, Douglas R. Luff

It is certified that error appears in the above-identified patent and that said Letters Patent are hereby corrected as shown below:

In the Abstract:

"5 x 10 inches Ω cm" should be changed to read ---5 x $10^{10}$ Ω cm---

In the Specifications:

Column 1 line 52:

Change "transducr" to read ---transducer---

Column 3 lines 52-53:

Change "level uranium of the" to read ---level of the uranium---

Column 6 line 34:

Change "tuype" to read ---type---

Column 5, Table 3 heading:

Change "REMENANT" to read ---REMANENT---

Signed and Sealed this

Fourteenth Day of December 1976

[SEAL]

*Attest:*

RUTH C. MASON
*Attesting Officer*

C. MARSHALL DANN
*Commissioner of Patents and Trademarks*